US012722069B2

(12) United States Patent
Timp et al.

(10) Patent No.: US 12,722,069 B2
(45) Date of Patent: Sep. 1, 2026

(54) SLIDING MITT

(71) Applicant: Wilson Sporting Goods Co., Chicago, IL (US)

(72) Inventors: Phillip Joseph Timp, Chicago, IL (US); Matthew J. Dierkes, Chicago, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 19/037,169

(22) Filed: Jan. 25, 2025

(65) Prior Publication Data

US 2026/0216584 A1 Jul. 30, 2026

(51) Int. Cl.
*A63B 71/14* (2006.01)
*A63B 102/18* (2015.01)

(52) U.S. Cl.
CPC ..... *A63B 71/143* (2013.01); *A63B 2102/18* (2015.10)

(58) Field of Classification Search
CPC ..... A41D 19/015; A41D 19/01523; A41D 19/01588; A41D 13/08; A41D 13/081; A41D 13/087; A41D 13/088; A63B 71/14; A63B 71/141; A63B 71/143
See application file for complete search history.

(56) References Cited

U.S. PATENT DOCUMENTS 1,509,801 A * 9/1924 Walters ..... A41D 19/01588 2/19
1,964,769 A * 7/1934 Rainey ..... A63B 71/143 2/19
2,109,974 A * 3/1938 O'Hara ..... A63B 71/143 2/19
2,154,197 A * 4/1939 Callaway ..... A63B 71/146 473/59
2,281,315 A * 4/1942 Latina ..... A63B 71/143 D29/115
2,699,551 A * 1/1955 Tompkins ..... A63B 71/143 D29/115
4,011,596 A * 3/1977 Chang ..... A63B 71/14 2/910
4,042,975 A * 8/1977 Elliott, Jr. ..... A63B 71/143 2/161.1
4,138,108 A * 2/1979 Robinson ..... A63B 71/14 273/DIG. 30
4,295,229 A * 10/1981 Clark ..... A63B 71/148 2/161.1

(Continued)

OTHER PUBLICATIONS

REI website selling "mittens" with three digit compartments (Year: 2026).*

*Primary Examiner* — Sally Haden

(74) *Attorney, Agent, or Firm* — Terence P. O'Brien; Erin F. Herdeman; Todd A. Rathe

(57) ABSTRACT

A sliding mitt includes an elastic inner body and an inelastic protective board. The elastic inner body has a phalange receiving region and a metacarpal receiving region. The inelastic protective board extends on a face of the elastic inner body over the phalange receiving region. A flexure hinge is provided between the metacarpal receiving region and the phalange receiving region to facilitate bending of the phalange receiving region relative to the metacarpal receiving region about and along the flexure hinge.

19 Claims, 9 Drawing Sheets

(56) References Cited

U.S. PATENT DOCUMENTS

| | | | | | |
|---|---|---|---|---|---|
| 4,766,612 | A * | 8/1988 | Patton, Sr. | A41D 19/01517 | 2/163 |
| 5,113,526 | A * | 5/1992 | Wang | A41D 31/245 | 36/58 |
| 5,295,269 | A * | 3/1994 | Ballard | A41D 19/01523 | 2/161.1 |
| 5,810,753 | A * | 9/1998 | Eberbach | A61F 5/0118 | 602/20 |
| 7,290,291 | B2 * | 11/2007 | Anderson | A41D 15/00 | 2/163 |
| 8,474,063 | B2 * | 7/2013 | Coulter | A63B 71/141 | 2/160 |
| 8,726,418 | B2 * | 5/2014 | DeBlasis | A41F 1/06 | 2/161.1 |
| 2004/0049141 | A1 * | 3/2004 | Slautterback | A61F 5/0118 | 602/21 |
| 2012/0245503 | A1 * | 9/2012 | DeVries | A41D 19/015 | 602/21 |
| 2014/0259258 | A1 * | 9/2014 | Miranda | A63B 71/143 | 2/16 |

* cited by examiner

SLIDING MITT

BACKGROUND

In sports such as baseball and softball, a player may attempt to slide into a base or home plate to avoid being tagged by an opposing team. During a headfirst slide, the player may reach for the base or home plate with his or her hand or hands. Sliding mitts are sometimes worn by the player to protect the player's hand or hands during a headfirst slide.

Figure 1:
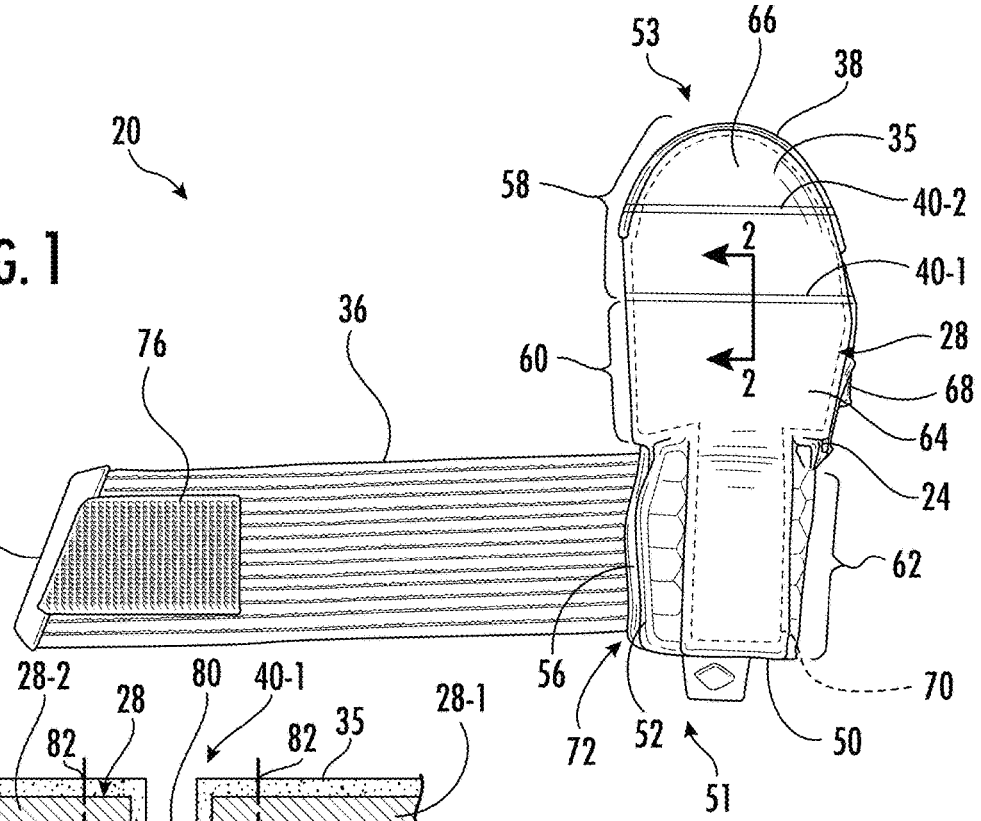
FIG. 1 is a top perspective view of an example sliding mitt having a wrist strap in an unwrapped state.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed are example sliding mitts, accessories for being worn by a ball player's hand when sliding towards and into a base. The example mitts insulate and protect the top and underside of the hand during such sliding. In some implementations, the example mitts include a bumper along the front tip of the mitt to protect fingertips during sliding.

In some implementations, the example mitts include an elastic inner body and an inelastic protective board that is to extend over phalange or finger receiving portions of the inner body. In such implementations, the mitts may further include a flexure hinge to facilitate bending of the phalange receiving region relative to a metacarpal receiving region about and along the flexure hinge. The flexure hinge provides improve finger dexterity, enhancing the ability of the ball player to securely grip the base upon reaching the base.

In some implementations, the inelastic protective board comprises an edge along at least a portion of the flexure hinge. In some implementations, the inelastic protective board comprise a first portion over the phalange receiving region on a distal side of the flexure hinge and a second portion over the metacarpal receiving region on a proximal side of the flexure hinge, the first portion being wider than the second portion to form the flexure hinge.

In some implementations, the flexure hinge is formed by a complete break or channel separating the protective board into two distinct panels, a phalange covering panel on a first side of the flexure hinge and a metacarpal covering panel on a second side of the flexure hinge. In some implementations, the flexure hinge is formed by a single indentation in one face of the protective board or a pair of indentations and opposite faces of the protective board which weaken the protective board to provide greater than the ability or flexibility along a line to form the flexure hinge. In some implementations, the flexure hinge is formed by a change in material composition along a hinge line, the material composition being less rigid or more flexible to provide the flexure hinge.

In some implementations, a first sideboard extends over the metacarpal region and is spaced from the second portion of the protective board on a first side of the second portion of the protective board. In some implementations, a second sideboard extends over the metacarpal region and is spaced from the second portion on a second side of the second portion. In some implementations, the first sideboard and the second sideboard are isolated from the inelastic protective board. In some implementations, the inelastic protective board, the first sideboard and the second sideboard are integrally formed as part of a single unitary body with a first partial slit separating the first sideboard and the inelastic protective board and with a second partial slit separating the second sideboard and the inelastic protective board. In such implementations, the first partial slit and the second partial slit each terminate near the proximal end of the inelastic protective board, wherein the inelastic protective board is connected to proximal ends of the first sideboard and the second sideboard.

In some implementations, the inelastic protective board, the first sideboard and the second sideboard are integrally formed as part of a single unitary body, wherein the first sideboard and second sideboard are separated by a groove or channel partially extending into the one or more layers forming the inelastic protective board, the first sideboard and the second sideboard. Said another way, a single board may provide each of the inelastic protective board, the first sideboard and the second sideboard, the single board having a thickness and a pair of grooves or channels partially extending into the thickness two separate the inelastic protective board from the first sideboard and the second sideboard. The grooves or channels assist in forming the flexure hinge.

In some implementations, the mitt comprises faces that mirror one another. For example, the mitt may comprise top and bottom faces. An inelastic protective board similar to the inelastic protective board described above may be provided along each of the top and bottom faces. Each of the top and bottom face and additionally include first and second sideboards as described above. As a result, the example mitts have a bilateral design allowing ball players to wear the mitt on either the left-hand or the right hand.

In some implementations, the mitt comprises a thumb opening. In some implementations, the mitt comprises at least one flap that covers or extends over the opening when a player's thumb is not passing through the opening. In some implementations, the at least one flap comprises a first flexible flap extending at least partially across the thumb opening in a first direction and a second flexible flap extending at least partially across the thumb opening in a second direction opposite the first direction, the second flexible flap overlapping the first flexible flap. The overlapping nature of the flaps inhibits the ingress of sand and dirt into the glove when the thumb opening is not being utilized.

In some implementations, the mitt may additionally comprise a wrist brace captured between the elastic inner body and the inelastic protective board along the second face. The wrist brace may comprise a curved rigid bar may have a length that is retained by the mitt so as to longitudinally extend across a wrist adjacent a hand that is flattened and extended within a hand receiving cavity of the elastic inner body. In those implementations where the mitt has top and bottom sides that mirror or that are identical to one another, each of the top side and the bottom side include a corresponding curved metal bar having a length and being retained so as to extend across a wrist adjacent a hand that is flattened and extended within the hand receiving cavity of the elastic inner body.

In some implementations, the mitts may additionally comprise an elastic strap at a proximal end of the mitt. The elastic strap is configured to wrap about the wrist associated with the hand inserted into the mitt. In some implementations, the elastic strap may be secured in a wrapped state by a hook and loop fastener system for adjustability as well as for quick on and off of the mitt.

For purposes of this disclosure, the term "coupled" shall mean the joining of two members directly or indirectly to one another. Such joining may be stationary in nature or movable in nature. Such joining may be achieved with the two members, or the two members and any additional intermediate members being integrally formed as a single unitary body with one another or with the two members or the two members and any additional intermediate member being attached to one another. Such joining may be permanent in nature or alternatively may be removable or releasable in nature.

For purposes of this disclosure, the phrase "configured to" denotes an actual state of configuration that fundamentally ties the stated function/use to the physical characteristics of the feature proceeding the phrase "configured to".

For purposes of this disclosure, the term "releasably" or "removably" with respect to an attachment or coupling of two structures means that the two structures may be repeatedly connected and disconnected to and from one another without material damage to either of the two structures or their functioning.

FIG. 1 illustrates portions of an example sliding mitt 20 in a state ready for insertion of a player's hand into the mitt. Sliding mitt 20 comprises an elastic inner body 24, an inelastic protective plate or protective board 28, cover 35, wrist strap 36 bumper 38 and flexure hinges 40-1, 40-2 (collectively referred to as flexure hinges 40).

Elastic inner body 24 comprises an elastic body in the shape of a mitten having a hand insertion opening 50 at a proximal end 51 and a closed ended interior 52 extending from the proximal 51 to a distal end 53. In the example illustrated, proximal portions of body 24 comprises an elongate slit 56 to facilitate widening of hand insertion opening 50. Slit 56 is held closed by wrapping of strap 36. In other implementations, slit 56 may be omitted.

Elastic inner body 24 comprises a finger or phalange receiving region 58, a metacarpal receiving region 60, and a wrist receiving region 62. The phalange receiving region 58 is sized or dimensioned so as to receive the fingers of an adult. The metacarpal receiving region 60 extends from the finger receiving portion towards the proximal end 51. The metacarpal receiving region 60 is configured to extend from the knuckles of the hand across the back or palm of the hand towards the wrist. The wrist receiving region 62 extends from the metacarpal receiving region 60 to the hand insertion opening 50, having a length to extend or span across the wrist of the player. In the example illustrated, body 24 further comprises a thumb opening 64. In other implementations, thumb opening 64 may be omitted.

In one example implementation, the elastic inner body 24 is formed from a rubber or rubberlike material. In one example implementation, elastic inner body 24 is formed from a synthetic rubber such as Neoprene (also known as polychloroprene). In such an implementation, the Neoprene comprises a laminated Neoprene, a closed celled synthetic rubber layer laminated on both sides with a fabric layer, such as nylon. In one example implementation, body 24 is formed from a laminated 4 mm thick laminated Neoprene. In other implementations, the synthetic rubber Neoprene core may be laminated with other fabric material layers. In other implementations, a different elastic layer or layers may be utilized to form elastic inner body 24.

Protective board 28 comprises a substantially flat or slightly curved inelastic and relatively stiff panel or plate extending along the top side of mitt 20. Protective board 28 is secured to or coupled to an exterior of body 24. In the example illustrated, protective board 28 is secured to the exterior outer surface of body 24 by cover 35 which is stitched to body 24. In other implementations, protective board 28 may be secured to the exterior outer surface of body 24 directly or indirectly in other fashions. For example, protective board may be fused or bonded to the exterior of body 24. In some implementations, board 28 is cut from a sheet and then secured to body 24. In other implementations, board 28 may be formed by molding and then positioned on body 24. In still other implementations, board 28 may be applied to the exterior of body 24 in a liquid form, such as being sprayed, poured or coated onto body 24, wherein the liquid subsequently solidifies and/or cures to a solid state forming the solid board 28.

Protective board 28 spans across both the phalange receiving region 58 and the metacarpal receiving region 60 of body 24. Board 28 has a stiffness and hardness greater than that of body 24. Board 28 provides a somewhat rigid and hard outer shell or plate for covering and protecting the back of the player's fingers received within phalange receiving region 58 and the back of the player's hand received within metacarpal receiving region 60. In the example illustrated, protective board 28 comprises phalange covering portion 66 and a metacarpal covering portion 68. Phalange covering portion 66 extends from flexure hinge 40-1 to a distal tip of mitt 20. Metacarpal covering portion 68 extends from flexure hinge 40-1 to wrist receiving region 62. In the example illustrated, board 28 further comprising a wrist covering portion 70 which extends over the wrist receiving region 62 of body 24 substantially to hand insertion opening 50. In some implementations, wrist covering portion 70 may be omitted.

In one example implementation, board 28 is formed from a polymer material, such as polyethylene. In some implementations, board 28 is formed from a 2 mm thick plate of polyethylene. In some implementations, board 28 comprises a 2-millimeter polyethylene board laminated with a protective covering, film or fabric. In one example implementation, the polyethylene board is laminated with an abrasion resistant fabric such as a ripstop nylon. In other implementations, board 28 may have a different thickness and/or may comprise a different inelastic polymer. In other implementations, board 28 may omit the outer laminate layers or may be laminated with other materials.

Cover 35 comprises a layer extending over and covering board 28. In some implementations, cover 35 comprises a fabric extending over board 28 and secured to body 24, such as by stitching. In some implementations, 35 comprises a felt material.

Wrist strap 36 comprises an elongate band having a first end 72 secured to wrist receiving region 62 of body 24 and a second free end 74 configured to be wrapped about wrist receiving region 62, across slit 56 to close slit 56. In some implementations camera strap 36 is elastic. Wrist strap 36 may provide support for the player's wrist. In the example illustrated, free end 74 comprises a fastener 76 in the form of a hook and loop fastener arrangement (a portion of which is shown) for securing free end 74 in a wrapped state about wrist receiving region 62 of body 24. In some implementations, the strap 36 may be omitted.

Bumper 38 comprises a protective layer of material extending along the edge of body 24 at distal end 53. In one implementation, bumper 38 extends a proximally 180° about the distal apex of body 24, 90° on each side of the distal apex. In one implementation, bumper 38 is formed from material that is harder than body 24. In some implementations, bumper 38 is formed from a compressible material, such as a foam material. In some implementations, bumper 38 is formed from a thick layer of synthetic rubber material. For example, in one implementation, bumper 38 may be for from a thermoplastic polyurethane (TPU) Bumper 38 protects the tips of the fingers within body 24. In yet other implementations, bumper 38 may be omitted.

Flexure hinges 40 each comprise an architecture or a configuration that facilitates bending of portions of board 28 away from the top or back face of mitt 20. Each of flexure hinges 40 (sometimes referred to as a flexural pivot) provides relative rotation between two adjacent relatively rigid members through bending. Each of flexure hinges 44 may flex or bend along a hinge line. In the example illustrated, flexure hinge 40-1 is located so as to extend along a hinge line between metacarpal receiving portion 60 and phalange receiving portion 58 of body 24, generally along the knuckles at the juncture of the metacarpals and proximal phalanges. Flexure hinge 40-2 is located between flexure hinge 40-1 and the distal tip of mitt 20 and the distal end 53 of mitt 20. In one example implementation, flexure hinge 40-2 extends along hinge line that is generally aligned with the knuckle joint between the proximal phalanges and the middle phalanges. In some implementations, flexure hinge 40-2 may be omitted. In some implementations, mitt 20 may be provided with additional flexure hinges 40 (such as flexure hinge 40-2) between flexure hinge 40-1 and the distal end 53.

FIG. 1 illustrates the top face or side of mitt 20 as including board 28. In some implementations, the bottom face side of mitt 20 may likewise include another board 28. In some implementations, the top face and the bottom face may mirror one another, wherein the board 28 on both sides are faces of mitt 20 have similar dimensions and profiles. In such implementations, mitt 20 may provide bilateral use, permitting a player to where mitt 20 on either his or her left-hand or his or her right hand. In other implementations, board 28 may be provided on a single side or face of body 24.

Figure 2:
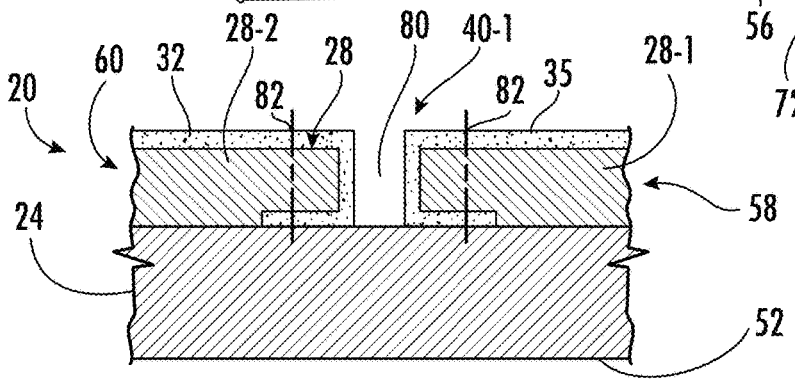
FIG. 2 is a sectional view of the sliding mitt of FIG. 1 taken along line 2-2.

FIG. 2 is a sectional view of mitt 20 of FIG. 1 taken along line 2-2. FIG. 2 illustrates the construction of flexure hinge 40-1. In the example illustrated, board 28 is split or broken into two isolated panels 28-1 and 28-2. Panel 28-1 is located over the phalange receiving portion 58 of body 24 while panel 28-2 is located over the metacarpal receiving portion 60 of body 24. Panels 28-1 and 28-2 are isolated from one another and are separated from one another by a break or channel 80 that extends between panels 28-1 and 28-2 and down to the bottom face of panels 28-1 and 28-2 which have edges facing and extending along channel 80. As result, panel 28-1 may be bent or pivoted about flexure line 40-1 relative to panel 28-2 and away from the back of the player's hand when gripping or hooking a base. During such bending or pivoting, the portion of the elastic body 24 opposite to or below channel 80 flexes or bends.

As further shown by the implementation shown in FIG. 2, cover 35 is secured to the exterior of panel 28-1 and 28-2, wrapping about such panels along channel 80 and being captured between a lower face of panel 28-1 and 28-2 and body 24. As further shown by FIG. 2, the cover 35 and panels 28-1, 28-2 may be secured to body 24 along channel 80 by stitches 82. In other implementations, panels 28-1 and 28-2 as well as cover 35 may be secured to body 24 by adhesives, welds or other securement methods.

In some implementations, flexure hinge 40-2 may have a construction similar to flexure hinge 40-1 shown in FIG. 2. In such an implementation, flexure 40-2 likewise comprises a channel 80, permitting the body 24 underlying portion of body 24 to bend or flex, permitting the fingers beyond the middle phalanges to bend relative to the middle phalanges. In some implementations, flexure hinge 40-2 may be omitted or may have a construction similar to the flexure hinge is shown and described below with respect to FIG. 3 and/or FIG. 4.

Figure 3:
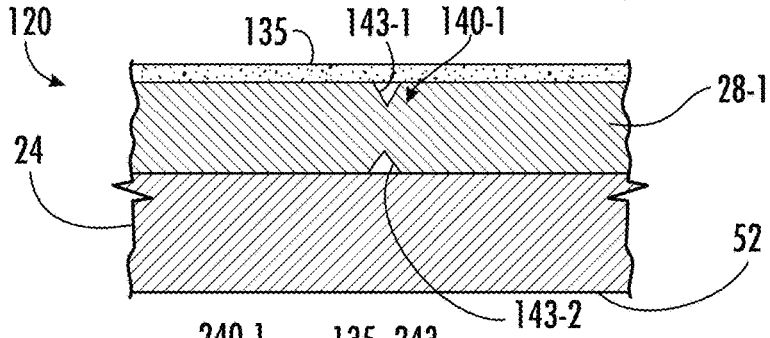
FIG. 3 is a sectional view of a sliding mitt taken along line 2-2 of FIG. 1.

FIG. 3 is a sectional view of sliding mitt 120. Sliding mitt 120 is identical sliding mitt 20 described above except the sliding mitt 120 comprises board 128, flexure hinge 140-1 and cover 135 in place of board 28, flexure hinge 40-1 and cover 35, respectively. Those remaining components of sliding mitt 120 which correspond to components of sliding mitt 20 are numbered similarly and/or are shown in FIG. 1.

Board 128 is similar to board 28 except the board 128 is formed from a single continuous unbroken, uninterrupted integral homogenous panel that continues extends across and over both the phalange receiving region 58 of body 24 and the metacarpal receiving region 60 of body 24. As shown by FIG. 3, flexure hinge 140-1 comprises channels, grooves, scores or other indentations 143-1, 143-2 extending into opposite faces of the board 128 between the phalanx receiving region 58 and the metacarpal receiving region 60 (generally above the proximal knuckles) of the hand inserted into the mitt 20). The indentations 143 have a depth and width such that they lessen the stiffness of board 128 along the hinge line forming flexure hinge 140-1, facilitating bending in the less thick portion formed by indentations 143. Although indentations 143 are illustrated as triangular scores or depressions, in other implementations, indentations 143 may be rounded, square, or polygon grooves. In some implementations, rather than a single elongate continuous uninterrupted indentation or groove, indentations 143 may comprise a series, line or row of distinct spaced indentations or depressions that facilitate bending or flexing along an axis of the series, line or row. Such indentations may be formed by molding or material removal processes.

Cover 135 is similar to cover 35 except that cover 135 continuously extends over and across indentation 143-1 on the outer face of board 128. In other implementations, cover 135 may extend into indentation 143-1. Although not shown, cover 135 and board 128 may be secured to the underlying body 24 by stitches, welds, adhesives or the like. In some implementations, mitt 120 may also replace flexure hinge 40-2 with a flexure hinge similar to flexure hinge 140-1, the flexure hinge 40-2 being formed by opposite or opposing indentations 143 that extend into opposite faces of the board 128. In some implementations, each of the flexure hinge is of mitt 120 may be formed by a single indentation extending into one of the two faces of board 128.

Figure 4:
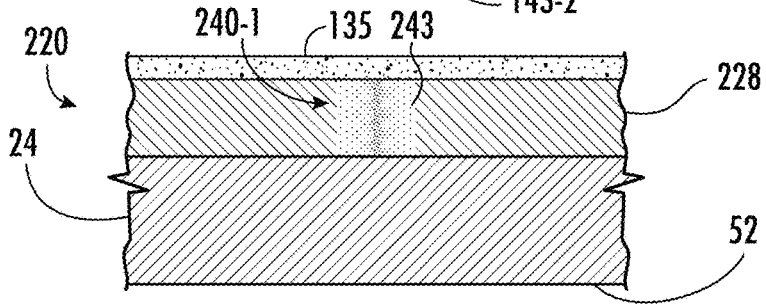
FIG. 4 is a sectional view of a sliding mitt taken along line 2-2 of FIG. 1.

FIG. 4 is a sectional view of sliding mitt 220. Sliding mitt 220 is identical to sliding mitt 120 described above except the sliding mitt 220 comprises board 228 and flexure hinge 240-1 in place of board 128 and flexure hinge 140-1, respectively. Those remaining components of sliding mitt 220 which correspond to components of sliding mitt 220 are numbered similarly and/or are shown in FIGS. 1 and 2.

Board 228 is similar to board 128 except the board 228 has a non-homogeneous or non-uniform material composition for form flexure hinge 240-1. As schematically shown by FIG. 4, flexure hinge 240-1 is formed by a material composition change 243 in regions along where the flexure hinge or hinge line is being formed. In particular, those particular portions of board 228 at flexure hinge 240-1 include a change in materials, changing to a material that is less stiff or more bendable or flexible as compared to the remainder of board 228, portions of which are distant from flexure hinge 240-1. As a result, those portions of board 228 forming flexure hinge 240-1 flex like a living hinge to permit phalanx covering region 66 to bend relative to metacarpal covering region 68, away from the back of the ball player's hand, to hook or grasp a base.

The construction or composition of board 228 forming flexure hinge 240-1 may likewise be similarly applied to form a flexure hinge in place of flexure hinge 40-2 shown in FIG. 1. In some implementations, flexure hinges 40-1, 40-2 shown in FIG. 1 may have different constructions. For example, one of flexure hinges 40-1, 40-2 may be formed by the channel 80 shown in FIG. 2 while the other flexure hinges 40-1, 40-2 has the indentations 143 (or one of indentations 143) shown in FIG. 3 and/or material composition change shown in FIG. 4. In some implementations, the flexure hinges 40-1, 40-2 shown in FIG. 1 may be a combination of what is shown in FIGS. 3 and 4. For example, the board 28 may have a material composition change 243 along the flexure hinges 40-1 and/or 40-2 and may additionally include indentations 143-1 and/or 143-2 along the hinge line.

In the example illustrated, each of boards 28, 128, 228 comprises a 2 millimeter polyethylene board laminated with a protective covering, film or fabric. In one example implementation, the polyethylene board is laminated with an abrasion resistant fabric such as ripstop nylon. In other implementations, each of such boards 28, 128, 228 may have a different thickness and/or may comprise a different inelastic polymer. In other implementations, such boards 28, 128, 228 may omit the outer laminate layers or may be laminated with other materials.

FIGS. 5-10 illustrate portions of an example sliding mitt 320. Sliding mitt 320 is bilateral, meaning that sliding mitt 320 may be worn on a player's left-hand or right-hand. The bilateral use of sliding mitt 320 is facilitated by the mirroring or similar construction of the top face 321 and the bottom face 322 (shown in FIG. 8) of sliding mitt 320. Sliding mitt 320 comprises inner body 324, inelastic protective plate or protective boards 328-1, 328-2 (collectively referred to as boards 328), sideboards 332-1, 332-2 (collectively referred to as sideboards 332), sideboards 334-1, 334-2 (collectively referred to as sideboards 334), covers 335, wrist strap 336, bumper 338, wrist braces 339-1, 339-2 (collectively referred to as wrist braces 339) (shown in FIGS. 6 and 9) and flexure hinges 340-1, 340-2 (collectively referred to as flexure hinges 340).

Inner body 324 is similar to inner body 24. Inner body 324 comprises an elastic body in the shape of a mitten having an axial hand insertion opening 350 at a proximal end 351 and a closed ended interior 352 at a distal end 353. In the example illustrated, proximal portions of body 324 comprise an elongate slit 356 to facilitate widening of hand insertion opening 350. Slit 356 is held closed by wrapping of strap 336. In other implementations, slit 356 may be omitted. In some implementations, both slit 356 and strap 336 may be omitted.

Figure 9:
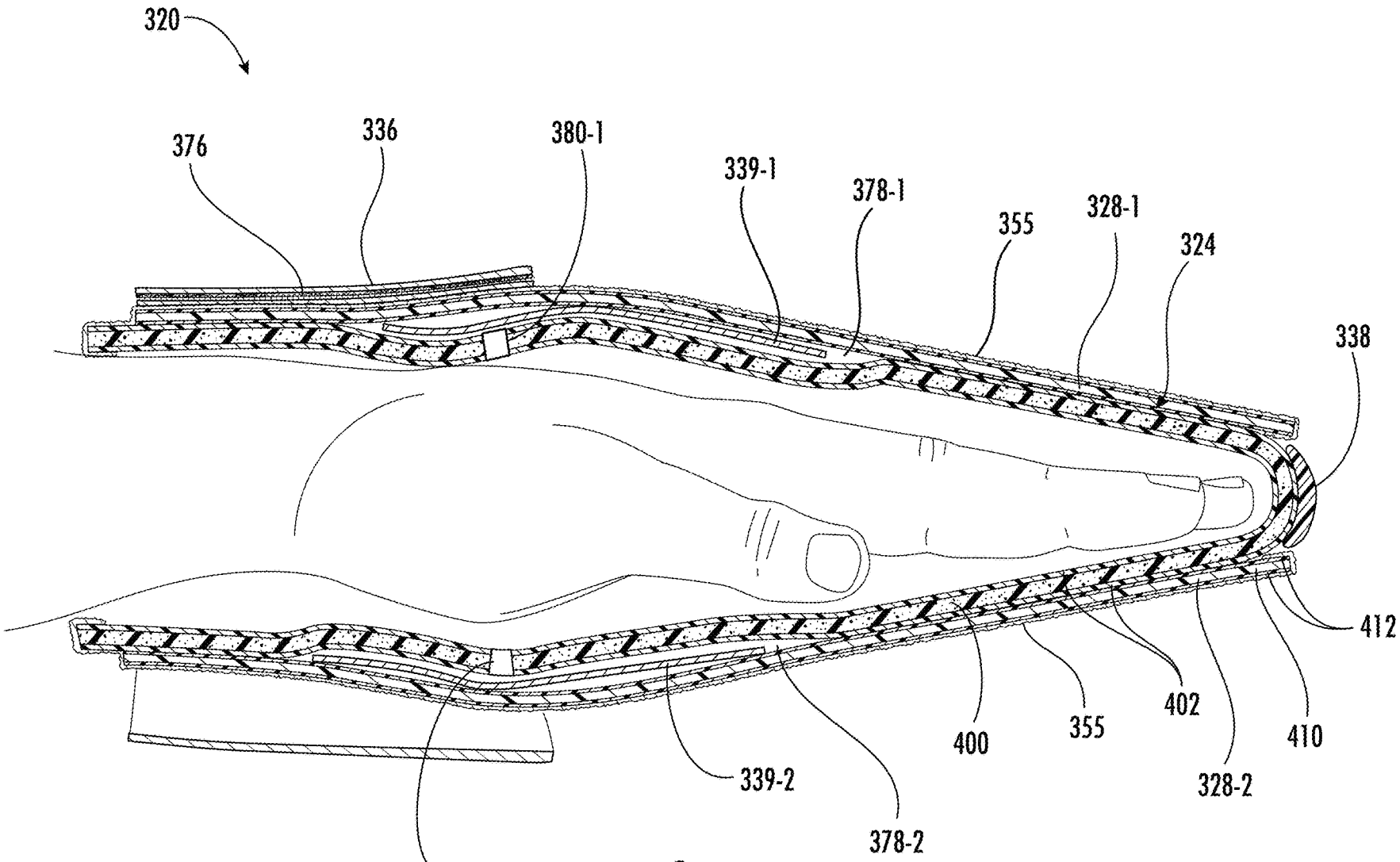
FIG. 9 is a sectional view of the sliding mitt of FIG. 7 taken along line 9-9.

Elastic inner body 324 comprises a finger or phalange receiving portion 358, a metacarpal receiving region 360, and a wrist receiving region 362. As shown by FIG. 9 which is a sectional view of mitt 320 receiving an average human male adult left hand, the phalange receiving region 358 is sized or dimensioned so as to receive the fingers of an adult. The metacarpal receiving region 360 extends from the finger receiving portion towards the proximal end 351. The metacarpal receiving region 360 is configured to extend from the knuckles of the hand across the back or palm of the hand towards the wrist. The wrist receiving region 362 extends from the metacarpal receiving region 360 to the hand insertion opening 350, having a length to extend or span across the wrist of the player. In the example illustrated, body 324 further comprises a thumb opening 64. In other implementations, thumb opening 364 may be omitted.

As shown by FIG. 9, the elastic inner body 324 is formed from a rubber or rubberlike material. In one example implementation, elastic inner body is formed from a synthetic rubber such as Neoprene (also known as polychloroprene). In such an implementation, the Neoprene comprises a laminated Neoprene, a closed celled synthetic rubber layer 400 laminated on both sides with a fabric layer 402, such as nylon. In one example implementation, body 324 is formed from a laminated 4 mm thick laminated Neoprene. In other implementations, the synthetic rubber Neoprene core may be laminated with other fabric material layers. In other implementations, a different elastic layer or layers may be utilized to form elastic inner body 324.

Protective boards 328 are located on opposite faces of mitt 320. Boards 328 are each substantially similar to one another. Each of boards 328 comprises a substantially flat or slightly curved inelastic and relatively stiff panel or plate extending along a respective face of mitt. Each of boards 328 is stiffer than body 324. Each of protective boards 328 is secured to or coupled to an exterior of body 324. In the example illustrated, each of protective boards 328 is secured to the exterior outer surface of body 324 by respective covers 335 which are stitched to body 324. In other implementations, each of protective boards 328 may be secured to the exterior outer surface of body 324 directly or indirectly in other fashions. For example, each of protective boards 328 may be fused or bonded to the exterior of body 324. In some implementations, each of protective boards 328 is cut to a desired shape and then secured to body 324. In other implementations, each of boards 328 may be formed by molding and then be positioned on body 324. In still other implementations, each of boards 328 may be applied to the exterior of body 324 in a liquid form, such as being sprayed, poured or coated onto body 324, wherein the liquids subsequently solidifies and/or cures to a solid state forming the solid board 328.

Figure 5:
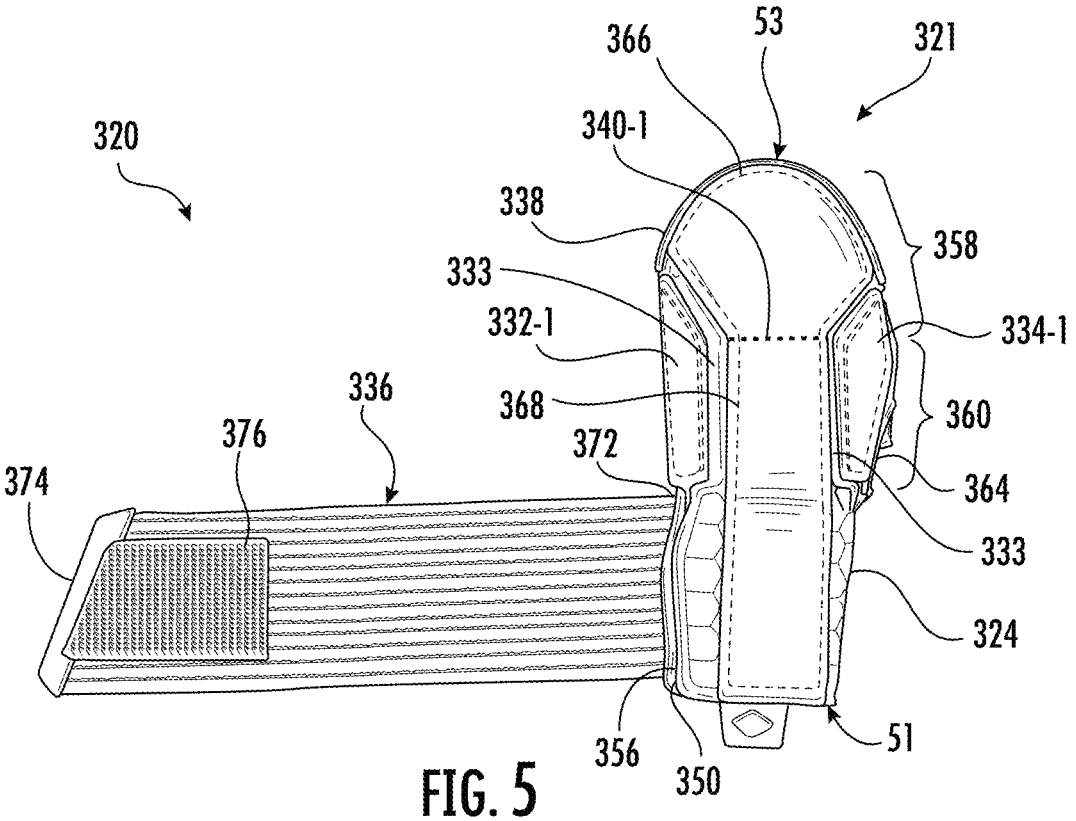
FIG. 5 is a top perspective view of an example sliding mitt having a wrist strap in an unwrapped state.

As shown by FIG. 5, protective board 328-1 spans across both the phalange receiving region 358 and the metacarpal receiving region 360 of body 324. Board 328-1 has a stiffness and hardness greater than that of body 324. Board 328-1 provides a rigid and hard outer shell or plate for covering and protecting the back of the player's fingers received within phalange receiving region 358 and the back of the player's hand received within metacarpal receiving region 360. In the example illustrated, protective board 328-1 comprises phalange covering portion 66 and a metacarpal covering portion 368. Phalange covering portion 366 extends from flexure hinge 340-1 to a distal tip of mitt 320. Metacarpal covering portion 368 extends from flexure hinge 340-1 to wrist receiving region 362. In the example illustrated, board 328 further comprising a wrist covering portion 370 which extends over the wrist receiving region 362 of body 324 to hand insertion opening 350. In some implementations, wrist covering portion 370 may be omitted.

In one example implementation, boards 328 are each formed from a polymer material, such as polyethylene. In some implementations, boards 328 are each formed from a 2 mm thick plate of polyethylene. As shown by FIG. 9, in some implementations, each of boards 328 comprises a 2 millimeter polyethylene board 410 laminated on both sides with a protective covering, film or fabric 412. In one example implementation, the polyethylene board 410 is laminated with an abrasion resistant fabric 412 such as ripstop nylon. In other implementations, each of boards 328 may have a different thickness and/or may comprise a different inelastic polymer. In other implementations, boards may omit the outer laminate layers or may be laminated with other materials.

Figure 10:
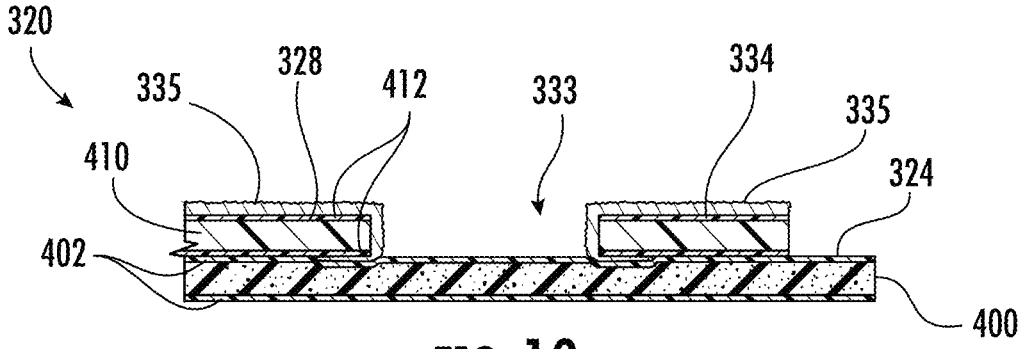
FIG. 10 is a sectional view of the sliding mitt of FIG. 7 taken along line 10-10.

Sideboards 332 and 334 extend on opposite lateral sides of metacarpal covering portions 368 of each of protective boards 328 and angle forwardly and outwardly towards distal end 53. Each of sideboards 332, 334 begins at wrist receiving region 362 and extends towards distal end 53. Sideboards 332, 334 are independent and distinct from protective boards 328, being separated or isolated from board 328 by uninterrupted channels 333 that separate sideboards 332, 334 from protective boards 328. As shown by FIG. 10, in the example illustrated, channel 333 comprise gaps that have a thickness equal to the thickness of sideboards 332, 334 and protective boards 328 such that the floor of such channels is provided by body 324.

Sideboards 332 and 334 protect lateral edge portions of a received hand not otherwise protected by boards 328. Sideboards 332 and 334 are similar in construction as boards 328. Each of sideboards 332 and 334 has a stiffness and hardness greater than that of body 324.

In one example implementation, sideboards 332, 334 are formed from the same material and have generally the same construction as that of protective boards 328. In some implementations, sideboards 332 and 334 are each formed from a polymer material, such as polyethylene. In some implementations, sideboards 332, 334 are each formed from a 2 mm thick plate of polyethylene. In some implementations, each of sideboards 332, 334 comprises a 2 millimeter polyethylene board laminated on both sides with a protective covering, film or fabric. In one example implementation, the polyethylene board is laminated with an abrasion resistant fabric such as ripstop nylon. In other implementations, each of boards 332, 334 may have a different thickness and/or may comprise a different inelastic polymer. In other implementations, boards may omit the outer laminate layers or may be laminated with other materials.

Figure 11:
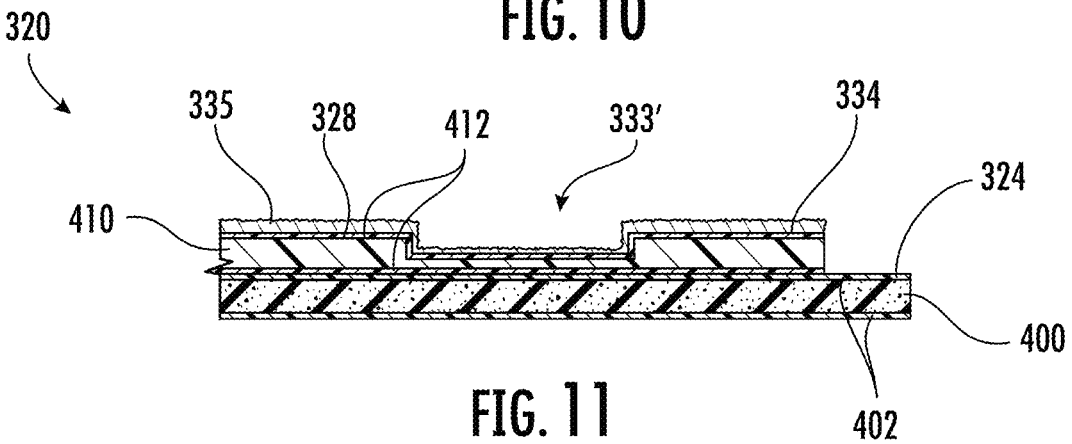
FIG. 11 is a sectional view of a sliding mitt taken along line 10-10 of FIG. 7.

As shown by FIG. 11, in some implementations, protective board 328 and one or both of sideboards 332, 334 may be integrally formed as part of a single body, a single continuous layer of material, wherein protective board 328 and the adjacent one of boards 332 and/or 334 are separated by a channel 333'. The channel 333' cuts into the thickness of the continuous layer forming both of board 328 and at least one of sideboards 332, 334, having a depth less than the thickness of board 328 and one or both of sideboards 332, 334. In some implementations, whether completely isolated from protective board 328 as shown in FIG. 10 or whether integrally formed as part of a single continuous layer with protective board 328 as shown in FIG. 11, one or both of sideboards 332, 334 may have a thickness or composition different than that of board 328. In some implementations, when integrally formed with the layer forming board 328 as shown in FIG. 11, one or both of sideboards 332, 334 may alternatively have a thickness equal to the thickness of the layer below channel 333', effectively eliminating one side of channel 333'. In some implementations, sideboards 332 and 334 may have a thickness gradually tapers (decreases) towards the lateral sides of body 324. In some implementations, sideboards 332 and 334 may be omitted.

Covers 335 comprise layers extending over and covering boards 328. In some implementations, the one or more covers 335 comprise a fabric extend over their respective one of boards 328, 332, 334 and are secured to body 324, such as by stitching. In some implementations, covers 335 are formed from a felt material. In some implementations, rather than each of boards 328 and each of sideboards 332, 334 having a dedicated cover 335, each cover 335 terminating along the edges of the respective boards and along the edges of channel 333, the one or more covers may alternatively cover more than one of boards 328, 332, 334, spanning across the channel 333 separating the adjacent sideboards 328, 332, 334. Cover 335 shown in FIG. 10 may alternatively span across channel 333, covering both of board 328 and board 334. In the example shown in FIG. 11, cover 335 continually spans across channel 333' covering both of sideboards 328 and 334.

Figure 8:
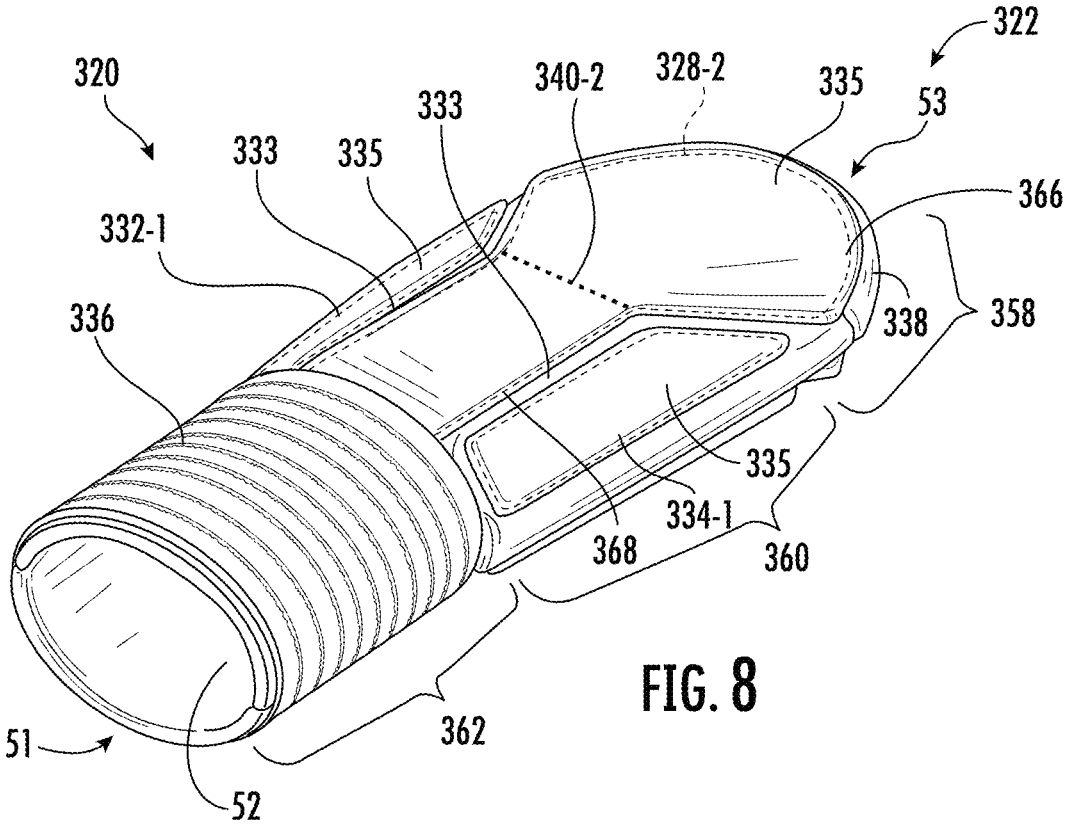
FIG. 8 is a bottom perspective view of the sliding mitt of FIG. 5 with the wrist strap in a wrapped state.
Figure 6:
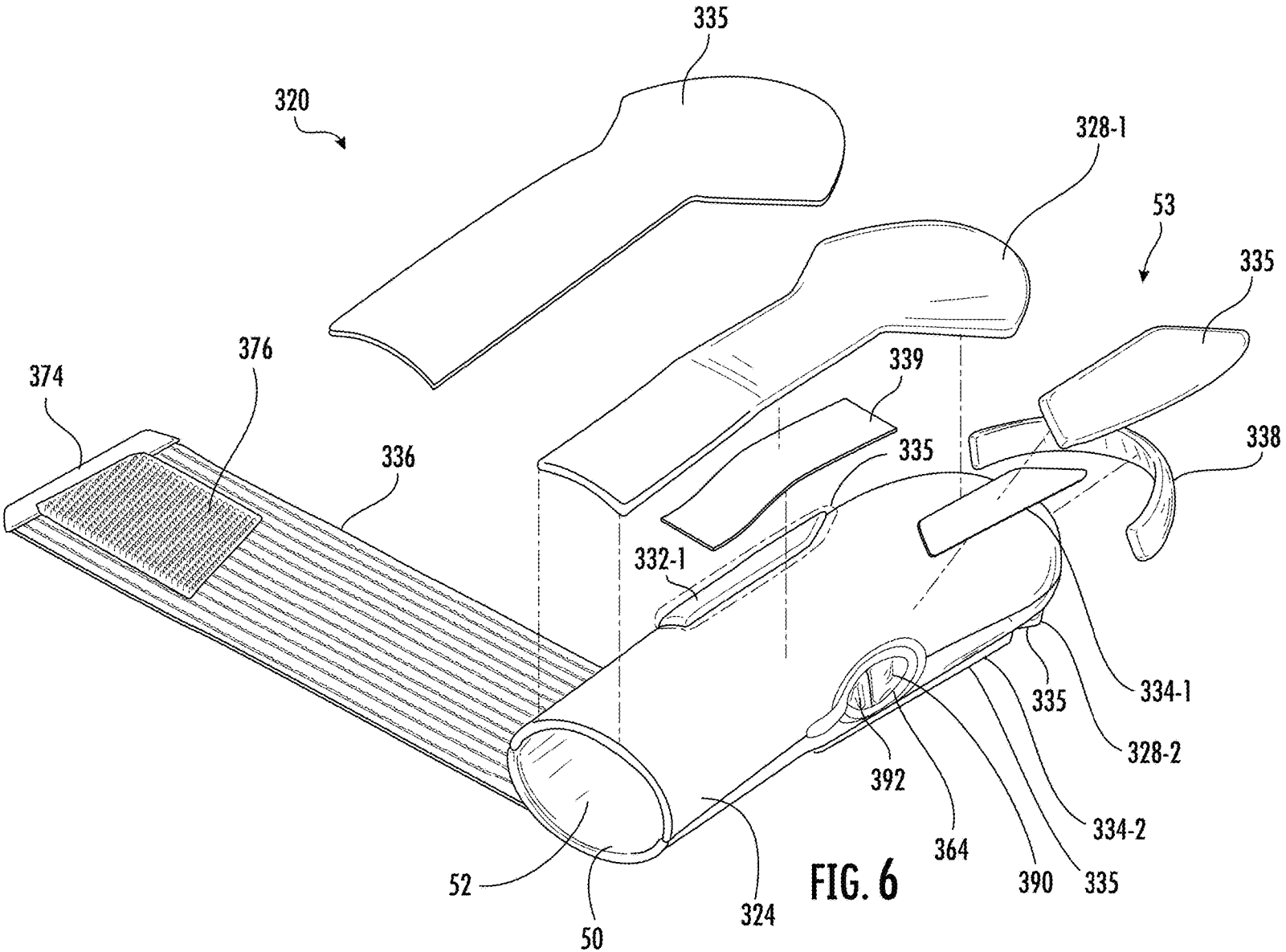
FIG. 6 is an exploded perspective view of the sliding mitt of FIG. 5.
Figure 7:
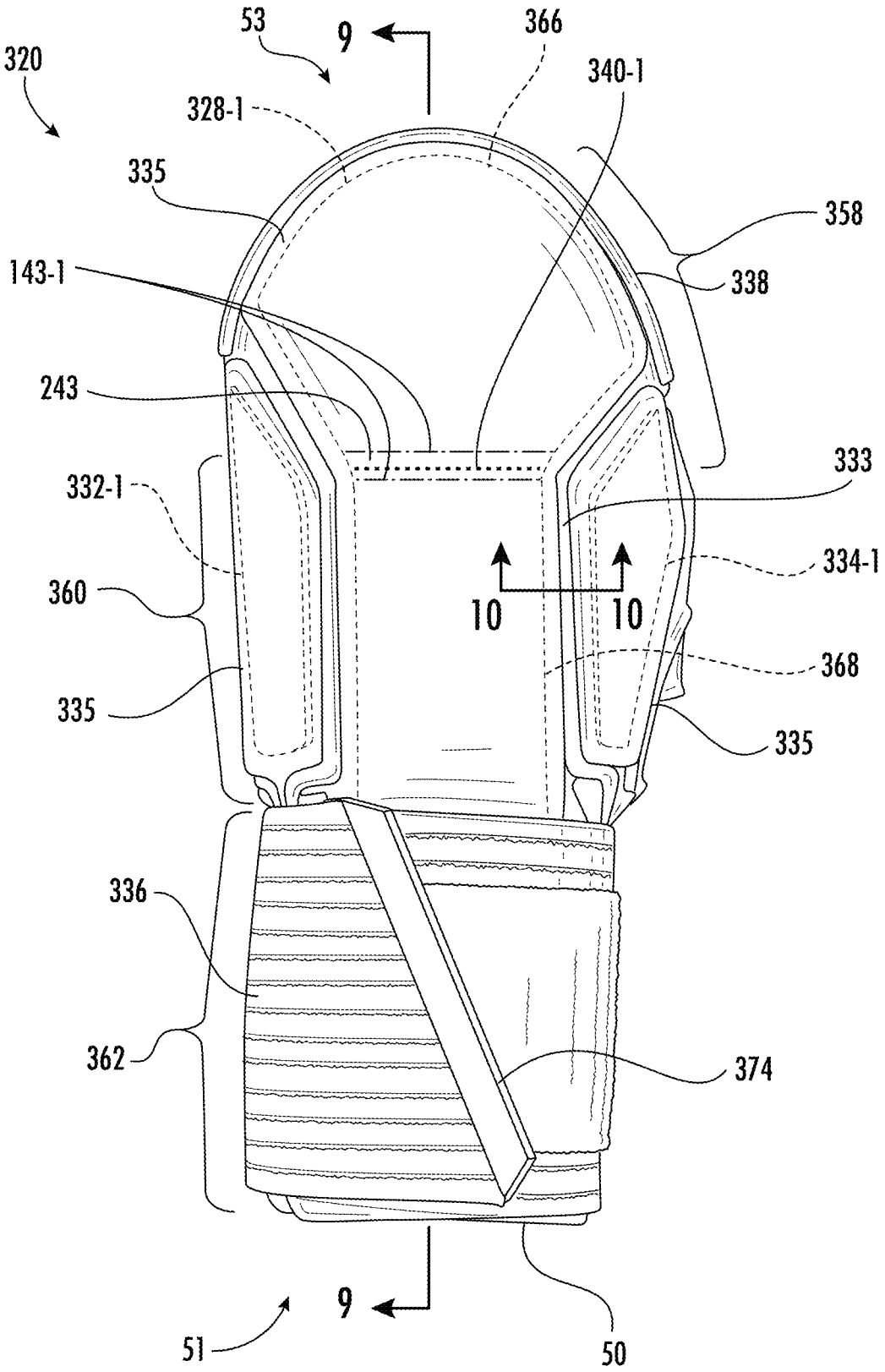
FIG. 7 is a top perspective view of the example sliding mitt of FIG. 5 with the wrist strap in a wrapped state.

Wrist strap 336 comprises an elongate band having a first end 372 secured to wrist receiving portion 362 of body 324 and a second free end 374 configured to be wrapped about wrist receiving portion 362, across slit 356 to close slit 356. FIGS. 7 and 8 illustrate mitt 320 with the wrist strap 336 being wrapped about the wrist and being secured in the wrapped state. In some implementations, strap 336 is elastic. Wrist strap 336 may provide support for the player's wrist. In the example illustrated, free end 374 comprises a fastener 376 in the form of a hook and loop fastener arrangement (a portion of which is shown) for securing free end 374 in a wrapped state about wrist receiving portion 362. In some implementations, the strap 336 may be omitted.

Bumper 338 comprises a protective layer of material extending along the edge of body 324 at distal end 53. In one implementation, bumper 338 extends approximately a proximally 180° about the distal apex of body 324, 90° on each side of the distal apex. In one implementation, bumper 338 is formed from material that is harder than body 324. In some implementations, bumper 338 is formed from a compressible material, such as a foam material. In some implementations, bumper 338 is formed from a thick layer of synthetic rubber material. In some implementations, bumper 338 is formed from a thermoplastic polyurethane (TPU). In yet other implementations, bumper 338 may be omitted. Bumper 338 protects the tips of the fingers within body 324.

Wrist braces 339 mirror one another on opposite faces of mitt 320. Wrist braces 339 comprise elongate panels or bars having a stiffness greater than that of protective boards 328. Wrist braces 339-1, 339-2 are captured between opposite faces of body 324 and protective boards 328-1, 328-2, respectively. As shown by FIG. 9, wrist braces 339 are located and configured (shaped and sized) so as to extend across (in a direction or along an axis extending between the proximal end 51 and the distal end 53 of mitt 320) the wrist of an average adult male hand received within the interior of mitt 320 as shown. In the example illustrated, each of wrist braces 339 further extends across the metacarpals and the opposite palm of the received hand. Each of wrist braces 339 has a length so as to underlie wrist strap when provided and wrapped about the wrist.

In the example illustrated, each of wrist braces 339 comprises a curved metal bar having a concave surface facing the received hand, facing inner body 324. In one example illustrated, the metal bar has a thickness of at least 1 mm and no greater than 8 mm. In some implementations, the metal bar has a transverse width of at least 0.5 inch and no greater than 3 inches for adequate bracing and coverage. In some implementations, the metal bar has a longitudinal length of at least 2 inches and no greater than 6 inches for adequate bracing and coverage. In some implementations, each of braces 339 comprises a 1.3 mm thick band of aluminum. In some implementations where mitt 320 is not bilateral and less wrist stabilization is acceptable, the wrist brace 339 on the bottom of mitt 320 (with the thumb position opposite to thumb opening 364) may be omitted.

In the illustrated example, wrist braces 339-1, 339-2 are received within corresponding pockets 378-1, 378-2 (collectively referred to as pockets 378) formed between body 324 and the outer protective boards 328-1 and 328-2, respectively. In some implementations, inner body 324 comprises a pair of opposite interior slits 380-1, 380-2 (collectively referred to as slits 380) that communicate with their respective pockets 378, wherein wrist braces 339 are inserted through such slits 380 into their respective pockets. In such implementations, the pockets have a length greater than the length of the received wrist braces 339 such that the wrist brace 339 may be slid slightly forwardly or rearwardly to accommodate slight variations in hand sizes, to accommodate player comfort, and to adapt to whether mitt 320 is being worn by the left-hand or the right hand, wherein the wrist brace 339 on the top of the received hand may be slightly longitudinally offset (one of braces 339 being closer to distal end 53 and the other braces 339 being closer to proximal end 51) relative to the wrist brace 339 on the bottom of the received hand for enhanced structural bracing.

In one example implementation, the proximal end of each of pockets 378 is spaced from the hand opening by a longitudinal distance of at least 40 mm and no greater than 60 mm. The distal end of each of pockets 378 is spaced from the distal apex of mitt 320 by a longitudinal distance of at least 95 mm and no greater than 110 mm. In some implementations, each of pockets 378 has a longitudinal length of a proximally 122 mm, wherein each of braces 339 has a longitudinal length of 105 mm (end to end in bent form). In such implementations, mitt 320 itself may have longitudinal length of 275 to 280 mm.

In yet other implementations, such pockets may be dimensioned so to match the length or longitudinal dimensions of brace 339. In lieu of being inserted through such slits, wrist brace 339 may be positioned inner body 324 and protective boards 328 by securing the protective boards 328 to inner body 324 with such braces 339 captured sandwiched therebetween, without the use or provision of slits. In some implementations, inner braces 339 may be adhesively bonded to inner body 324 or the outer protective board 328. In some implementations, wrist braces 339 may be omitted.

Flexure hinges 340-1 and 340-2 each comprise architectures or configurations that facilitate bending of portions of boards 328-1 and 328-1, respectively. Each of flexure hinges 340 (sometimes referred to as a flexural pivot) provides relative rotation between two adjacent relatively rigid members through bending. Each of flexure hinges 340 may flex along a hinge line. In the example illustrated, when mitt 320 is receiving a hand with the palm facing towards a then front of the mitt 320, the flexure hinge 340-1 on the back of the mitt is located so as to extend along a hinge line between metacarpal receiving region 360 and phalange receiving region 358 of body 324, generally along the knuckles at the juncture of the metacarpals and proximal phalanges. As shown by FIG. 8, when the glove is flipped for being worn by a right hand, the thumb opening 364 being located on a left side of the glove, flexure hinge 340-2 so as to extend along a hinge line between metacarpal receiving region 360 and phalange receiving region 358 of body 324, generally along the knuckles at the juncture of the metacarpals and proximal phalanges. In some implementations, additional flexure hinges, such as flexure hinge 40-2 in FIG. 1, may be provided between flexure hinge 40-1 and the distal end 53.

As shown by FIG. 5, the distal phalange covering portion 366 of board 328 is wider than proximal metacarpal covering portion 368, wherein the junction of portions 366 and 368, where portion 366 begins to widen from portion 368, forms a natural flexure hinge serving as flexure hinge 340-1 on one side of mitt 320 and a second flexure hinge 340-2 provided on the opposite side of mitt 320. Flexure hinges 340-1, 340-2 of particular regions where the central inelastic protective boards 328 are more likely to bend or pivot, enhancing the ability of the ballplayer's fingers to bend along the flexure hinges 340, providing enhanced finger dexterity for hooking or gripping a base being stolen or reached. Because mitt 320 comprises protective board 328 on both faces of mitt 320 and because both faces of mitt 320 include aligned flexure hinges 340 on both faces of mitt 320, both the front and the back of the hand are protected and those portions of mitt 320 covering the fingers or phalanges on both faces (the palm side and the back of the hand) of the received hand are more easily bent for hooking a base.

In some implementations, flexure hinges 340 may be modified to provide further enhanced bending for their respective hinge lines. For example, as schematically shown by the—.—(dashed) lines in FIG. 7, in some implementations, flexure hinges 340 may additionally have indentations similar to indentations 143 shown in described above with respect to FIG. 3 (the—.—lines representing the outer edges of the indentations) and/or may additionally have a changing material composition (represented by the stippling) in boards 328, such as the material change 243 shown and described above with respect to FIG. 4. In some implementations, flexure hinges 340 may be replaced with a channel, such as channel 80 shown and described above with respect to FIG. 2 (the—.—dashed lines alternatively representing outer edges of the channel 80).

Figure 12:
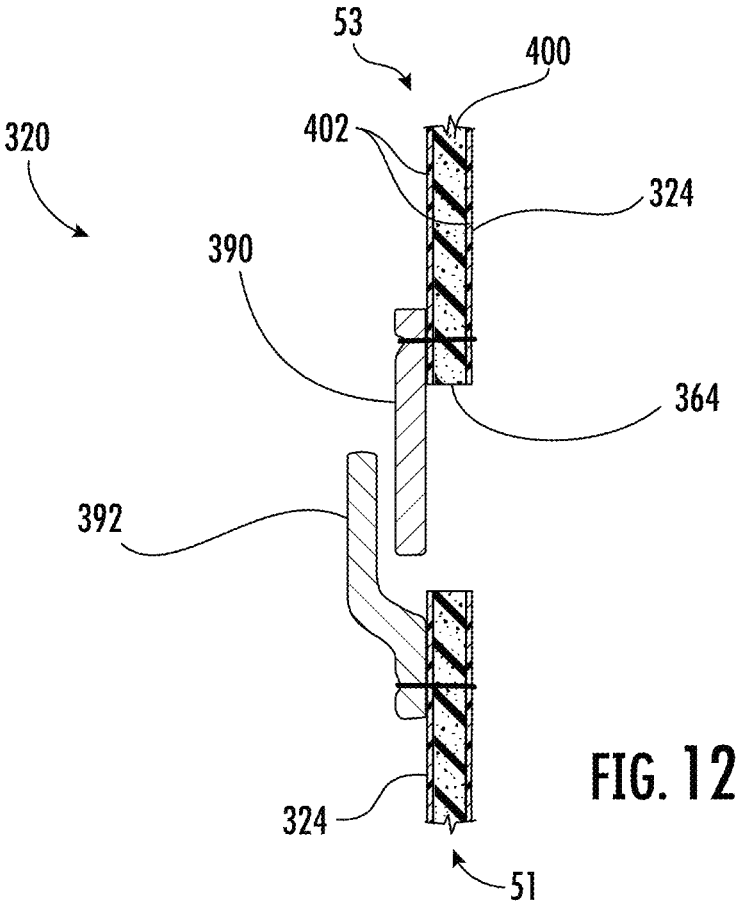
FIG. 12 is a sectional view of the sliding mitt of FIG. 13 taken along line 12-12.

FIG. 12 illustrates one example of thumb opening 364 in inner body 324. Thumb opening 364 is located and sized to permit a person's thumb through passed through opening 364 or to be retained within mitt 320. In the example illustrated, mitt 320 comprises at least one flexible flap covering the thumb opening 364, the at least one flexible flap being movable to open the thumb opening 364 and permit passage of a player's thumb. The at least one flexible flap is movable between an extended thumb opening closing state in which the at least one flexible flap extends across and over the thumb opening 364 and a thumb opening withdrawn state opening a thumb passage extending from an interior of the hand receiving cavity to an exterior of the sliding mitt through the thumb opening 364. In the example illustrated, mitt 320 comprises flap 390 and flap 392. Flap 390 is secured to inner body 324 along the interior of mitt 320 on a first side of opening 364 proximate to distal end 53. Flap 390 extends at least partially across opening 364 towards proximal end 51.

Flap 392 is secured to inner body 324 along the interior of mitt 320 on a second side of opening 364 proximate to the proximal end 51. Flap 392 extends at least partially across opening 364 towards the distal end 53. Flap 392 overlaps flap 390 when spanning opening 364 on an interior side of flap 390. Flap 390 extends at least partially across the thumb opening 364 in a first direction while flap 392 extends at least partially across the thumb opening 364 in a second direction opposite the first direction. Flap 392 overlaps 390, wherein edge portions of flap 390 and flap 392 are movable away from one another to separate and create a space between the edge portions to open a thumb passage that extends from the interior of the hand receiving cavity to the exterior of the sliding mitt through the space.

Figure 13:
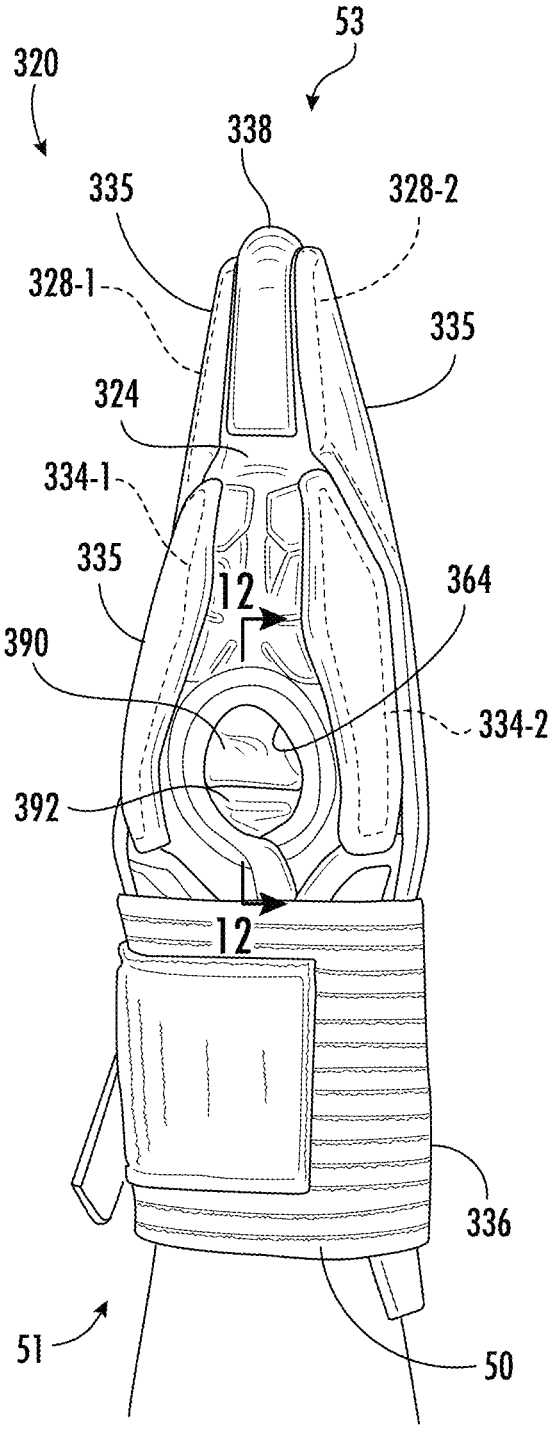
FIG. 13 is a side view of the example sliding mitt of FIG. 7 with a player's thumb retracted within the mitt.
Figure 14:
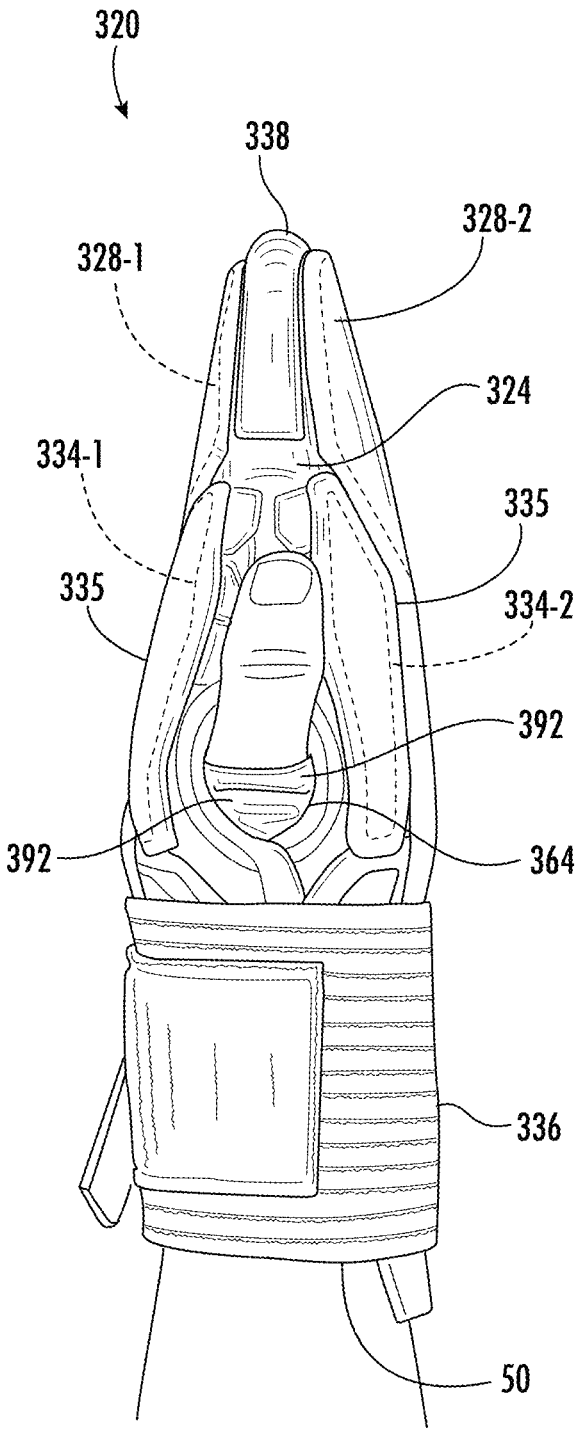
FIG. 14 is a side view of the example sliding mitt of FIG. 7 with the player's thumb extending through a thumb opening in the example mitt.

FIGS. 13 and 14 illustrate side views of mitt 320. FIG. 13 illustrates mitt 320 with flaps 390 and 392 closing thumb opening 364 (with the thumb residing within mitt 320). FIG. 14 illustrates the player's thumb passing through thumb opening 364. In the illustrated example, flap 392 is bent back or retracted within the interior of mitt 320, permitting the thumb to pass between flaps 392 and 390, extending over flap 390 along the exterior side of mitt 320.

Figure 15:
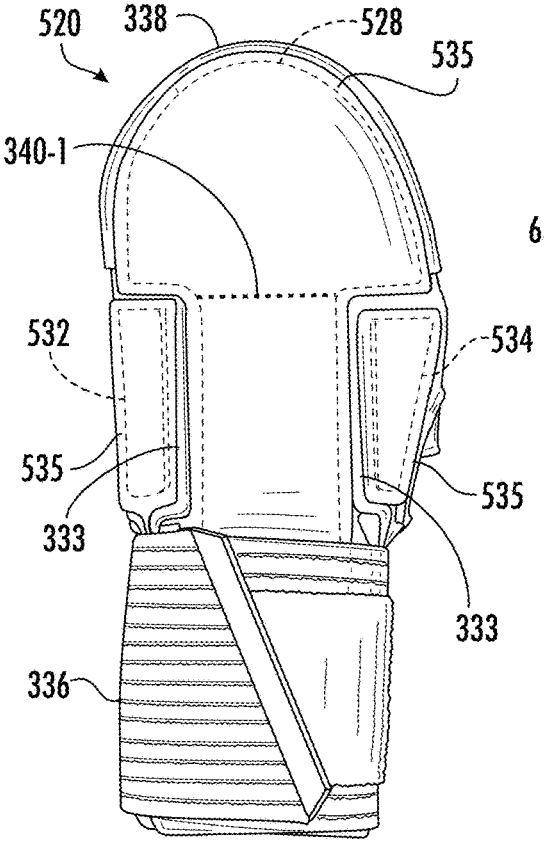
FIG. 15 is a top perspective view of an example sliding mitt with an example wrist strap in a wrapped state.
Figure 16:
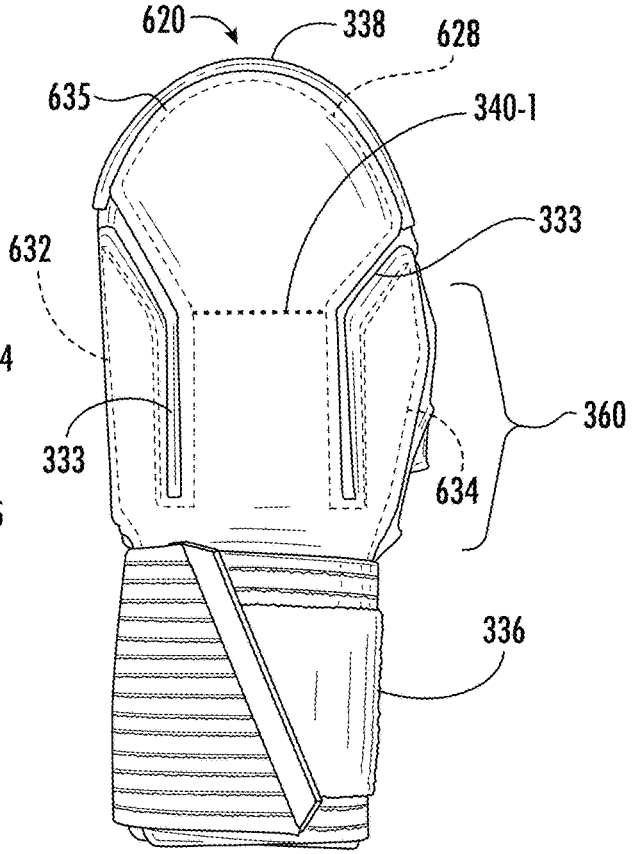
FIG. 16 is a top perspective view of an example sliding mitt with an example wrist strap in a wrapped state.
Figure 17:
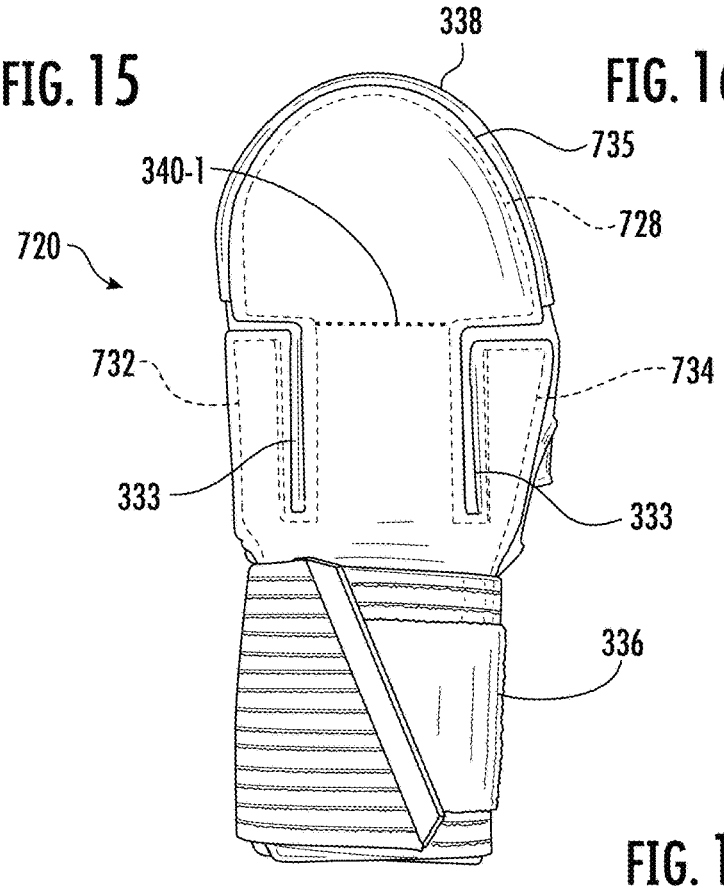
FIG. 17 is a top perspective view of an example sliding mitt with an example wrist strap in a wrapped state.

FIGS. 15-17 illustrate alternative example configurations for mitt 320. FIG. 15 illustrates sliding mitt 520. Sliding mitt 520 is similar to sliding mitt 320 described above except that mitt 520 comprises protective board 528 and sideboards 332, 534 (and the associated covers 535) in place of protective board 328, sideboards 332, 334 and the associated covers 335, on the top and bottom face of mitt 520. Those remaining components of mitt 520 which correspond to components of mitt 320 are numbered similarly and/or are shown and described above respect to mitt 320.

Protective board 528 and sideboards 532, 534 are similar to protective board 328 and sideboards 332, 334 except that the protective board 528 and the sideboards 532, 534, respectively, on each face of mitt 520 are differently shaped. The different states still facilitate bending along the illustrated hinge line forming flexure hinge 340-1 (and the corresponding flexure hinge on the opposite face of mitt 520). In the illustrated example, the phalange covering portion of protective board 528 is semi ovular in shape, offering greater protection for the lateral sides of the phalanges, the bases or proximal ends of pinky and the index finger.

FIG. 16 illustrates sliding mitt 620. Sliding mitt 620 is similar to sliding mitt 320 described above except that mitt 620 comprises protective board 628 and sideboards 632, 634 (and the associated covers 635) in place of protective board 328, sideboards 332, 334 and the associated covers 335, on the top and bottom face of mitt 620. Those remaining components of mitt 620 which correspond to components of mitt 320 are numbered similarly and/or are shown and described above respect to mitt 320.

Protective board 628 and sideboards 632, 634 are similar to protective board 328 and sideboards 332, 334, respectively, except that the protective board 628 and the sideboards 632, 634 on each face of mitt 620 are integrally formed from a single unitary body or layer/panel, still being separated by channels 333, but being connected to one another at the proximal end of metacarpal covering portion 360. The proximal end and of metacarpal covering regions of board 628 are integrally formed as part of a single layer with the proximal ends of sideboards 632, 624. As result, the combination of protective board 628 and each of the sideboards 632, 634 is formed from a single piece or panel with a distally extending channels 333, providing the panel with a "W" shape. Likewise, covers 635 on each face of mitt 620 may be formed from a single piece having a "W" shape corresponding to the shape of the single piece providing protective board 628 and sideboards 632, 634. As with mitt 320, mitt 620 facilitates bending along the illustrated hinge line forming flexure hinge 340-1 (and the corresponding flexure hinge on the opposite face of mitt 620. The construction of mitt 620 may facilitate the use of fewer parts/pieces and simpler construction.

FIG. 17 illustrates sliding mitt 720. Sliding mitt 720 is similar to sliding mitt 620 described above except that mitt 720 comprises protective board 728 and sideboards 732, 734 (and the associated covers 735) in place of protective board 628, sideboards 632, 634 and the associated covers 635, on the top and bottom face of mitt 720. Those remaining components of mitt 720 which correspond to components of mitt 620 are numbered similarly and/or are shown and described above respect to mitt 620.

Protective board 728 and sideboards 732, 734 are similar to protective board 628 and sideboards 632, 634, respectively, except that the protective board 728 and the sideboards 732, 734 on each face of mitt 520 are differently shaped. The different states still facilitate bending along the illustrated hinge line forming flexure hinge 340-1 (and the corresponding flexure hinge on the opposite face of mitt 720). In the illustrated example, the phalange covering region of protective board 728 is semi ovular in shape, offering greater protection for the lateral sides of the phalanges, the bases or proximal ends of the pinky and the index finger.

Figure 18:
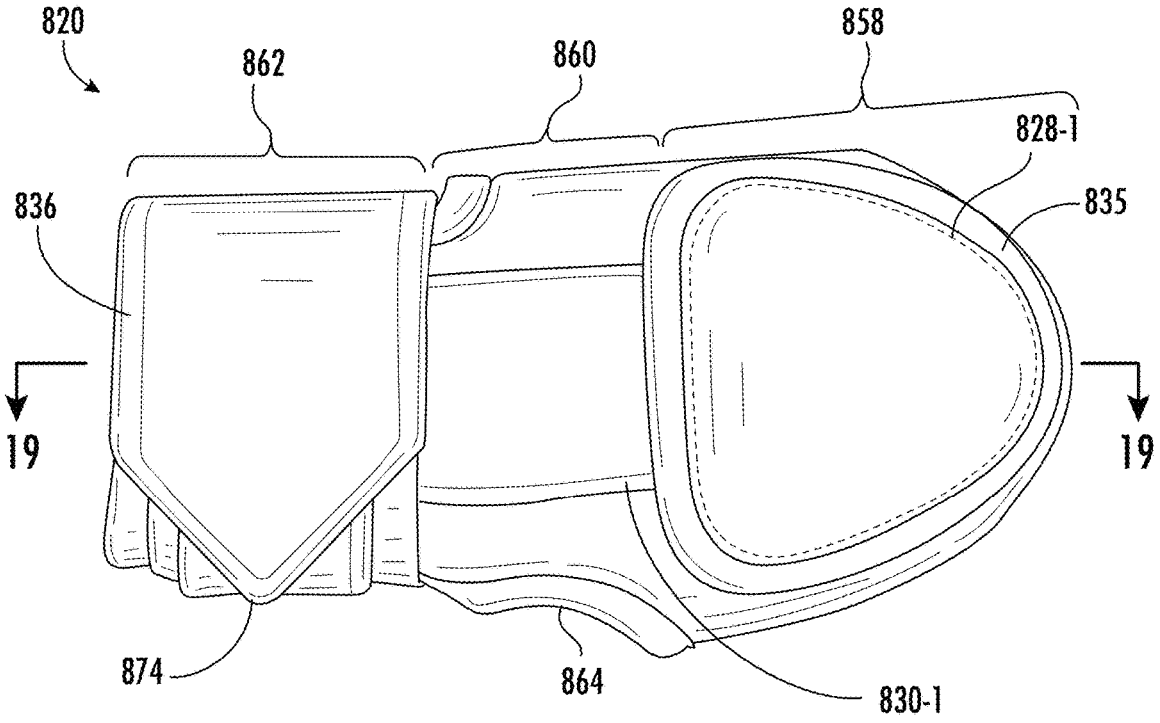
FIG. 18 is a top perspective view of an example sliding mitt.
Figure 19:
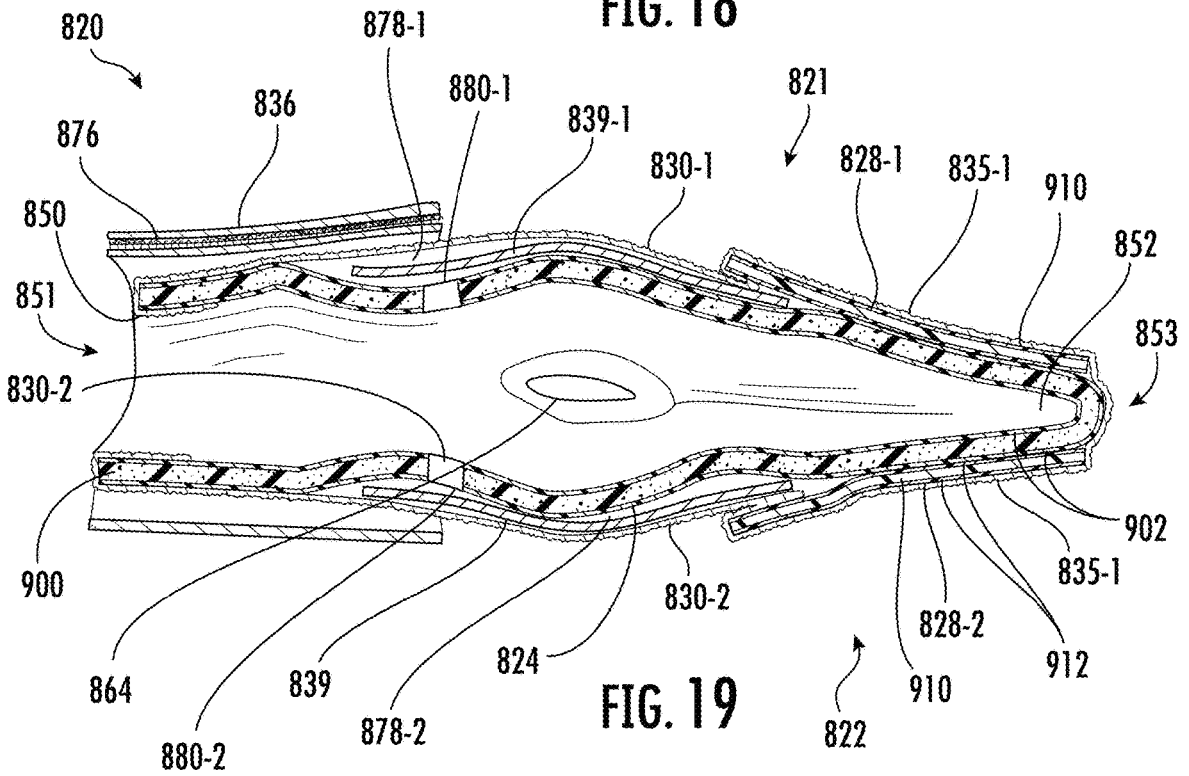
FIG. 19 is a sectional view of the example sliding mitt of FIG. 18 taken along line 19-19.

FIGS. 18 and 19 illustrate an example sliding mitt 820. Sliding mitt 820 may be configured for youth. Sliding mitt 320 is bilateral, meaning that sliding mitt 820 may be worn on a player's left-hand or right-hand. The bilateral use of sliding mitt 820 is facilitated by the mirroring or similar construction of the top face 821 and the bottom face 822 (shown in FIG. 19) of sliding mitt 820. Sliding mitt 820 comprises inner body 824, inelastic protective plate or protective boards 828-1, 828-2 (collectively referred to as boards 828), outer panels 830-1, 830-2 (collectively referred to as outer panels 830), covers 835, wrist strap 836, wrist braces 839-1, 839-2 (collectively referred to as wrist braces 839) (shown in FIG. 19).

Inner body 824 is similar to inner body 324. Inner body 824 comprises an elastic body in the shape of a mitten having an axial hand insertion opening 350 at a proximal end 851 and a closed ended interior 852 at a distal end 353. In the example illustrated, proximal portions of body 824 comprises an elongate slit to facilitate widening of hand insertion opening 850. The slit may be held closed by wrapping of strap 836. In other implementations, slit may be omitted. In some implementations, both slit 856 and strap 836 may be omitted.

Elastic inner body 824 comprises a finger or phalange receiving portion 858, a metacarpal receiving region 860, and a wrist receiving region 862. As shown by FIG. 19 which is a sectional view of mitt 820 receiving an average male youth (age 8 to 12) left hand, the phalange receiving region 858 is sized or dimensioned so as to receive the fingers of the youth. The metacarpal receiving region 860 extends from the finger receiving portion towards the proximal end. The metacarpal receiving region 360 is configured to extend from the knuckles of the hand across the back or palm of the hand towards the wrist. The wrist receiving region 862 extends from the metacarpal receiving region 860 to the hand insertion opening 50, having a length to extend or span across the wrist of the player. In the example illustrated, body 824 further comprises a thumb opening 864. In other implementations, thumb opening 864 may be omitted.

As shown by FIG. 19, the elastic inner body 824 is formed from a rubber or rubberlike material. In one example implementation, elastic inner body is formed from a synthetic rubber such as Neoprene (also known as polychloroprene). In such an implementation, the Neoprene comprises a laminated Neoprene, a closed celled synthetic rubber layer 900 laminated on both sides with a fabric layer 902, such as nylon. In one example implementation, body 824 is formed from a laminated 4 mm thick laminated Neoprene. In other implementations, the synthetic rubber Neoprene core may be laminated with other fabric material layers. In other implementations, a different elastic layer or layers may be utilized to form elastic inner body 824.

Protective boards 828 are located on opposite faces of mitt 820 at distal end 853 of mitt 820. Boards 828 are each substantially similar to one another. In the example illustrated, each of boards 828 has a generally semicircular or semi ovular shape. Each of boards 828 comprises a substantially flat or slightly curved inelastic and relatively stiff panel or plate extending along a respective face of mitt 820. Each of protective boards 828 is secured to or coupled to an exterior of body 824. In the example illustrated, each of protective boards 828 is secured to the exterior outer surface of body 824 by respective covers 835 which are stitched to body 824. In other implementations, each of protective boards 828 may be secured to the exterior outer surface of body 824 directly or indirectly in other fashions. For example, each of protective boards 828 may be fused or bonded to the exterior of body 824. In some implementations, each of protective boards 828 is cut from a sheet and provided with a desired shape and then secured to body 824. In other implementations, each of boards 828 may be formed by molding and then position on body 824. In still other implementations, each of boards 828 may be applied to the exterior of body 824 in a liquid form, such as being sprayed, poured or coated onto body 824, wherein the liquids subsequently solidifies and/or cures to a solid state forming the solid board 828.

As shown by FIG. 19, protective board 828-1 spans across the phalange receiving portion 358, terminating at the metacarpal receiving portion 860 of body 824. Board 828-1 has a stiffness and hardness greater than that of body 824. Board 828-1 provides a rigid and hard outer shell or plate for covering and protecting the back of the players fingers received within phalange receiving portion 358.

As shown by FIG. 19, protective board 828-1 spans across the phalange receiving portion 358, terminating at the metacarpal receiving portion 860 of body 824. Board 828-1 has a stiffness and hardness greater than that of body 824. Board 828-1 provides a rigid and hard outer shell or plate for covering and protecting the back of the player's fingers received within phalange receiving portion 358.

Outer panels 830-1, 830-2 comprise flexible panels that extend from protective boards 828-1 and 828-2, respectively towards hand opening 850. Outer panels 830 are secured to inner body 824 by adhesive, stitches or welds. In the example illustrated outer panels 830 extend to hand opening 850. Panels 830 have a distal end sandwiched between protective boards 828 and inner body 824. In one implementation, outer panels 830 comprise a leather or synthetic leather. In some implementations, outer panels 830 comprise swayed. In other implementations, outer panels 830 may be formed from other materials, such as Palmer panels, fabrics or the like.

Covers 835 comprises a layer extending over and covering boards 828. In some implementations, the one or more covers 835 comprise a fabric extending over their respective boards 828 and are secured to body 824, such as by stitching. In some implementations, covers 835 are formed from a felt material.

Wrist strap 836 comprises an elongate band having a first end secured to wrist receiving portion 862 of body 824 and a second free end 874 configured to be wrapped about wrist receiving portion 862, across the slit to close the slit. FIG. 18 illustrates the wrist strap 836 being wrapped about the wrist and being secured in the wrapped state. In some implementations, strap 836 is elastic. Wrist strap 836 may provide support for the player's wrist. In the example illustrated, free end 874 comprises a fastener 876 in the form of a hook and loop fastener arrangement (a portion of which is shown) for securing free end 874 in a wrapped state about wrist receiving portion 862. In some implementations, the strap 836 may be omitted.

Wrist braces 839 mirror one another on opposite faces of mitt 820. Wrist braces 839 comprise elongate panels or bars having a stiffness greater than that of protective boards 828. Wrist braces 839-1, 839-2 are captured between opposite faces of body 824 and those of panels 830 or protective boards 828-1, 828-2, respectively. As shown by FIG. 19, wrist braces 839 are located and configured (shaped and sized) so as to extend across (in a direction or along an axis extending between the proximal end 851 and the distal end 8 53 of mitt 820) the wrist of an average youth (age 8 to 12) male hand received within the interior of mitt 820 as shown. In the example illustrated, each of wrist braces 839 further extends across the metacarpals and the opposite palm of the received hand. Each of wrist braces 839 has a length so as to underlie wrist strap 836, when provided and wrapped about the wrist.

In the example illustrated, each of wrist braces 839 comprises a curved metal bar having a concave surface facing the received hand, facing inner body 824. In one example illustrated, the metal bar has a thickness of at least 1 mm and no greater than 2 mm, while being formed from an aluminum alloy. In one example implementation, each of braces 839 comprise a 1.3 mm formed aluminum stay. In some implementations, the metal bar has a transverse width of at least 30 mm and no greater than 45 mm for adequate bracing and coverage. In some implementations, the metal bar has a longitudinal length of at least 90 mm and no greater than 125 mm for adequate bracing and coverage. In some implementations where mitt 820 is not bilateral and less wrist stabilization is acceptable, the wrist brace 839 on the bottom of mitt 820 (with the thumb position opposite to thumb opening 864) may be omitted.

In the illustrated example, wrist braces 839-1, 839-2 are received within corresponding pockets 878-1, 878-2 (collectively referred to as pockets 878) formed between body 824 and the outer panels 830-1, 830-2, respectively. In some implementations, inner body 824 comprises a pair of opposite interior slits 880-1, 880-2 (collectively referred to as slits 880) that communicate with their respective pockets 878, wherein wrist braces 839 are inserted through such slits 880 into their respective pockets. In such implementations, the pockets have a length greater than the length of the received wrist braces 839 such that the wrist brace 839 may be slid slightly forwardly or rearwardly to accommodate slight variations in hand sizes, to accommodate player comfort, and to adapt to whether mitt 820 is being worn by the left-hand or the right hand, wherein the wrist brace 839 on the top of the received hand may be slightly longitudinally offset (one of braces 839 being closer to distal end 853 and the other braces 839 being closer to proximal end 851) relative to the wrist brace 839 on the bottom of the received hand for enhanced structural bracing. In yet other implementations, such pockets may be dimensioned so to match the length or longitudinal dimensions of brace 839. In lieu of being inserted through such slits, wrist brace 839 may be positioned inner body 824 and protective boards 828 by securing the protective boards 828 to inner body 824 with such braces 839 captured sandwiched therebetween, without the use or provision of slits. In some implementations, inner braces 839 may be adhesively bonded to inner body 824 or the outer protective board 828. In some implementations, wrist braces 839 may be omitted.

In one example implementation, each of braces 839 has a longitudinal length (invent form) of at least 90 mm and no greater than 110 mm, and in some implementations, 100 mm. Each of the pockets 878 has a longitudinal length at least 10 mm greater than the longitudinal length of the received cross brace 839. In one implementation, each of such pockets 878 has a longitudinal length of at least 90 mm, no greater than hundred 120 mm, and in some implementations, 115 mm. The distal end of each of pockets 878 is spaced from the distal apex of mitt 820 by distance of at least 70 mm, no greater than 80 mm, and in some implementations, 75 mm. The proximal end of each of pockets 878 is largely spaced from the hand opening by at least 30 mm, no greater than 40 mm, and in some implementations, 35 mm. In such implementations mitt 820 has a total longitudinal length of at least 200 mm, no greater than 250 mm, and in some implementations, 225 mm.

Although the present disclosure has been described with reference to example implementations, workers skilled in the art will recognize that changes may be made in form and detail without departing from the scope of the claimed subject matter. For example, although different example implementations may have been described as including features providing benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A sliding mitt comprising:

an elastic inner body longitudinally extending from a proximal end to a distal end of the sliding mitt, the elastic inner body having a first face and a second face separated from the first face by a hand receiving cavity, the hand receiving cavity comprising a hand insertion opening at the proximal end, a closed interior end at the distal end, a phalange receiving region extending to the distal end, and a metacarpal receiving region between the phalange receiving region and the proximal end;

an inelastic protective board on the first face and over the phalange receiving region;

a flexure hinge on the first face between the metacarpal receiving region and the phalange receiving region to facilitate bending of the phalange receiving region relative to the metacarpal receiving region about and along the flexure hinge;

a second inelastic protective board on the second face and over the phalange receiving region; and a second flexure hinge on the second face between the metacarpal receiving region and the phalange receiving region to facilitate bending of the phalange receiving region relative to the metacarpal receiving region about and along the second flexure hinge.

2. The sliding mitt of claim 1, wherein the inelastic protective board comprises an edge along at least a portion of the flexure hinge.

3. The sliding mitt of claim 1, wherein the inelastic protective board comprises a first portion over the phalange receiving region on a distal side of the flexure hinge and a second portion over the metacarpal receiving region on a proximal side of the flexure hinge, the first portion being wider than the second portion to form the flexure hinge.

4. The sliding mitt of claim 3 further comprising:

a first sideboard over the metacarpal receiving region and spaced from the second portion on a first side of the second portion; and a second sideboard over the metacarpal receiving region and spaced from the second portion on a second side of the second portion.

5. The sliding mitt of claim 4, wherein the first sideboard and the second sideboard are isolated from the inelastic protective board.

6. The sliding mitt of claim 4, wherein the inelastic protective board, the first sideboard and the second sideboard are integrally formed as part of a single unitary body with a first partial slit separating the first sideboard and the inelastic protective board and with a second partial slit separating the second sideboard and the inelastic protective board.

7. The sliding mitt of claim 1 further comprising a curved wrist brace captured between the elastic inner body and the inelastic protective board, the curved wrist brace having a length and located so as to longitudinally extend across a wrist adjacent a hand that is flattened and extended within the hand receiving cavity.

8. The sliding of claim 7, wherein the curved wrist brace is slidably received within a pocket formed in the sliding mitt.

9. The sliding mitt of claim 1 further comprising a fingertip bumper along the distal end of the elastic inner body, the fingertip bumper having a length configured to continuously span across fingertips of a middle finger, ring finger and index finger of a hand when the hand is fully received within the sliding mitt.

10. The sliding mitt of claim 1, wherein the second inelastic protective board comprises a second edge along at least a portion of the second flexure hinge.

11. The sliding mitt of claim 1, wherein the second inelastic protective board comprise a third portion over the phalange receiving region on a distal side of the flexure hinge and a fourth portion over the metacarpal receiving region on a proximal side of the flexure hinge, the third portion being wider than the fourth portion to form the second flexure hinge.

12. The sliding mitt of claim 1 further comprising:

a third sideboard over the metacarpal region and spaced from the second inelastic protective board on a first side of the second inelastic protective board; and a fourth sideboard over the metacarpal region and spaced from the second inelastic protective board on a second side of the second inelastic protective board.

13. The sliding mitt of claim 12, wherein the third sideboard and the fourth sideboard are isolated from the second inelastic protective board.

14. The sliding mitt of claim 13, wherein the second inelastic protective board, the third sideboard and the fourth sideboard are integrally formed as part of a single unitary body with a third partial slit separating the third sideboard and the second inelastic protective board and with a fourth partial slit separating the fourth sideboard and the second inelastic protective board.

15. The sliding mitt of claim 1 further comprising a second curved wrist brace captured between the elastic inner body and the second inelastic protective board along the second face, the second wrist brace having a length and located so as to longitudinally extend across a wrist adjacent a hand that is flattened and extended within the hand receiving cavity.

16. The sliding mitt of claim 1, wherein the inelastic protective board comprises a polymer plate having a continuous uninterrupted width configured to extend over a middle finger, a ring finger and an index finger of a hand when the hand is fully received within the sliding mitt.

17. The sliding mitt of claim 1, wherein the phalange receiving region comprises an uninterrupted continuous cavity laterally extending from a first lateral side of the sliding mitt to a second opposite lateral side of the sliding mitt, the phalange receiving region being configured to receive mutually contacting fingers of a hand when the hand is received within the phalanx receiving region.

18. A sliding mitt comprising:

an elastic inner body longitudinally extending from a proximal end to a distal end of the sliding mitt, the elastic inner body having a first face and a second face separated from the first face by a hand receiving cavity, the hand receiving cavity comprising a hand insertion opening at the proximal end, a closed interior end at the distal end, a phalange receiving region extending to the distal end, and a metacarpal receiving region between the phalange receiving region and the proximal end;

an inelastic protective board on the first face and over the phalange receiving region; and a flexure hinge on the first face between the metacarpal receiving region and the phalange receiving region to facilitate bending of the phalange receiving region relative to the metacarpal receiving region about and along the flexure hinge, wherein the inelastic protective board comprises a first portion over the phalange receiving region on a distal side of the flexure hinge and a second portion over the metacarpal receiving region on a proximal side of the flexure hinge, the first portion being wider than the second portion to form the flexure hinge, wherein the sliding mitt further comprises:

a first sideboard over the metacarpal receiving region and spaced from the second portion on a first side of the second portion; and a second sideboard over the metacarpal receiving region and spaced from the second portion on a second side of the second portion, wherein the first sideboard and the second sideboard are isolated from the inelastic protective board.

19. A sliding mitt comprising:

an elastic inner body longitudinally extending from a proximal end to a distal end of the sliding mitt, the elastic inner body having a first face and a second face separated from the first face by a hand receiving cavity, the hand receiving cavity comprising a hand insertion opening at the proximal end, a closed interior end at the distal end, a phalange receiving region extending to the distal end, and a metacarpal receiving region between the phalange receiving region and the proximal end;

an inelastic protective board on the first face and over the phalange receiving region; and a flexure hinge on the first face between the metacarpal receiving region and the phalange receiving region to facilitate bending of the phalange receiving region relative to the metacarpal receiving region about and along the flexure hinge, wherein the inelastic protective board comprises a first portion over the phalange receiving region on a distal side of the flexure hinge and a second portion over the metacarpal receiving region on a proximal side of the flexure hinge, the first portion being wider than the second portion to form the flexure hinge, wherein the sliding mitt further comprises:

a first sideboard over the metacarpal receiving region and spaced from the second portion on a first side of the second portion; and a second sideboard over the metacarpal receiving region and spaced from the second portion on a second side of the second portion, wherein the inelastic protective board, the first sideboard and the second sideboard are integrally formed as part of a single unitary body with a first partial slit separating the first sideboard and the inelastic protective board and with a second partial slit separating the second sideboard and the inelastic protective board.

* * * * *